US011569612B2

(12) United States Patent
Wang et al.

(10) Patent No.: US 11,569,612 B2
(45) Date of Patent: Jan. 31, 2023

(54) ELECTRICAL CONNECTOR ASSEMBLY HAVING A PAIR OF LATCHES AND A PAIR OF BUTTONS PIVOTABLE TO OPERATE THE LATCHES

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Cai-Yuan Wang, Kunshan (CN); Zhi-Yong Zhou, Kunshan (CN); Ying-Xing Ma, Kunshan (CN); Chien-Hsun Huang, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 17/315,336

(22) Filed: May 9, 2021

(65) Prior Publication Data

US 2021/0351546 A1 Nov. 11, 2021

(30) Foreign Application Priority Data

May 9, 2020 (CN) ..... 202010384991.3
May 9, 2020 (CN) ..... 202020751446.9

(51) Int. Cl.
*H01R 13/627* (2006.01)
*H01R 13/502* (2006.01)

(52) U.S. Cl.
CPC ..... *H01R 13/6275* (2013.01); *H01R 13/502* (2013.01)

(58) Field of Classification Search
CPC ... H01R 13/6275; H01R 13/502; H01R 24/64
See application file for complete search history.

(56) References Cited

U.S. PATENT DOCUMENTS 5,486,117 A * 1/1996 Chang ..... H01R 12/727 439/353
6,132,231 A * 10/2000 Suzuki ..... H01R 13/6275 439/352
6,957,976 B2 * 10/2005 Zhang ..... H01R 13/6275 439/358
7,175,465 B1 2/2007 Tsai
7,445,486 B2 * 11/2008 Shen ..... H01R 13/6275 439/353

(Continued)

*Primary Examiner* — Abdullah A Riyami
*Assistant Examiner* — Nader J Alhawamdeh
(74) *Attorney, Agent, or Firm* — Ming Chieh Chang

(57) ABSTRACT

An electrical connector assembly includes a plug connector, a cable electrically connecting to the plug connector, an outer cover enclosing the plug connector and the cable, a pair of latches mounted to the plug connector, and a pair of buttons mounted to the outer cover for operating the pair of latches, wherein each of the pair of latches includes a spring arm, a securing portion at an inner side of the spring arm, and a pressing portion at an outer side of the spring arm, and each of the pair of buttons includes a pivot at one end thereof, a stopper at an opposite end thereof, and an abutting portion coupled to the pressing portion.

6 Claims, 14 Drawing Sheets

(56) References Cited

U.S. PATENT DOCUMENTS

| | | | | |
|---|---|---|---|---|
| 7,955,114 | B2 * | 6/2011 | Wu | H01R 13/6275 439/352 |
| 10,236,605 | B1 * | 3/2019 | Henry | H01R 12/732 |
| 2013/0164990 | A1 * | 6/2013 | Tsai | H01R 24/62 439/660 |
| 2020/0343674 | A1 * | 10/2020 | Nogawa | H01R 9/0512 |

* cited by examiner

ELECTRICAL CONNECTOR ASSEMBLY HAVING A PAIR OF LATCHES AND A PAIR OF BUTTONS PIVOTABLE TO OPERATE THE LATCHES

BACKGROUND OF THE INVENTION

1. Field of the Invention

The present invention relates to an electrical connector assembly including a plug connector, a cable electrically connecting to the plug connector, an outer cover enclosing the plug connector and the cable, a pair of latches, and a pair of buttons, wherein the pair of latches and the pair of buttons are designed and arranged to facilitate easy and reliable assembly and operation.

2. Description of Related Arts

U.S. Pat. No. 5,486,117 discloses an electrical connector assembly including a plug connector, a cable electrically connecting to the plug connector, an outer cover enclosing the plug connector and the cable, and a pair of latch arms, wherein the outer cover has a pair of integrally over-molded portions for operating the pair of latch arms.

SUMMARY OF THE INVENTION

An electrical connector assembly comprises a plug connector, a cable electrically connecting to the plug connector, an outer cover enclosing the plug connector and the cable, a pair of latches mounted to the plug connector, and a pair of buttons mounted to the outer cover for operating the pair of latches, wherein each of the pair of latches includes a spring arm, a securing portion at an inner side of the spring arm, and a pressing portion at an outer side of the spring arm, and each of the pair of buttons includes a pivot at one end thereof, a stopper at an opposite end thereof, and an abutting portion coupled to the pressing portion.

DETAILED DESCRIPTION OF THE PREFERRED EMBODIMENTS

Figure 1:
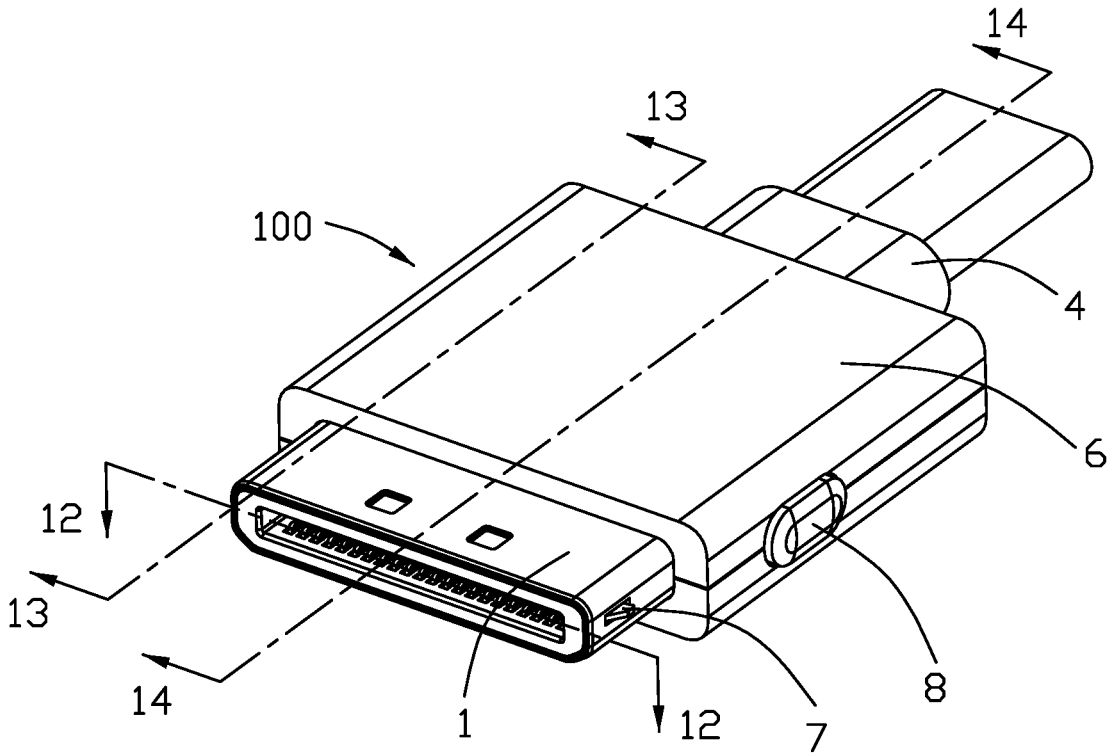
FIG. 1 is a perspective view of an electrical connector assembly in accordance with the present invention.
Figure 2:
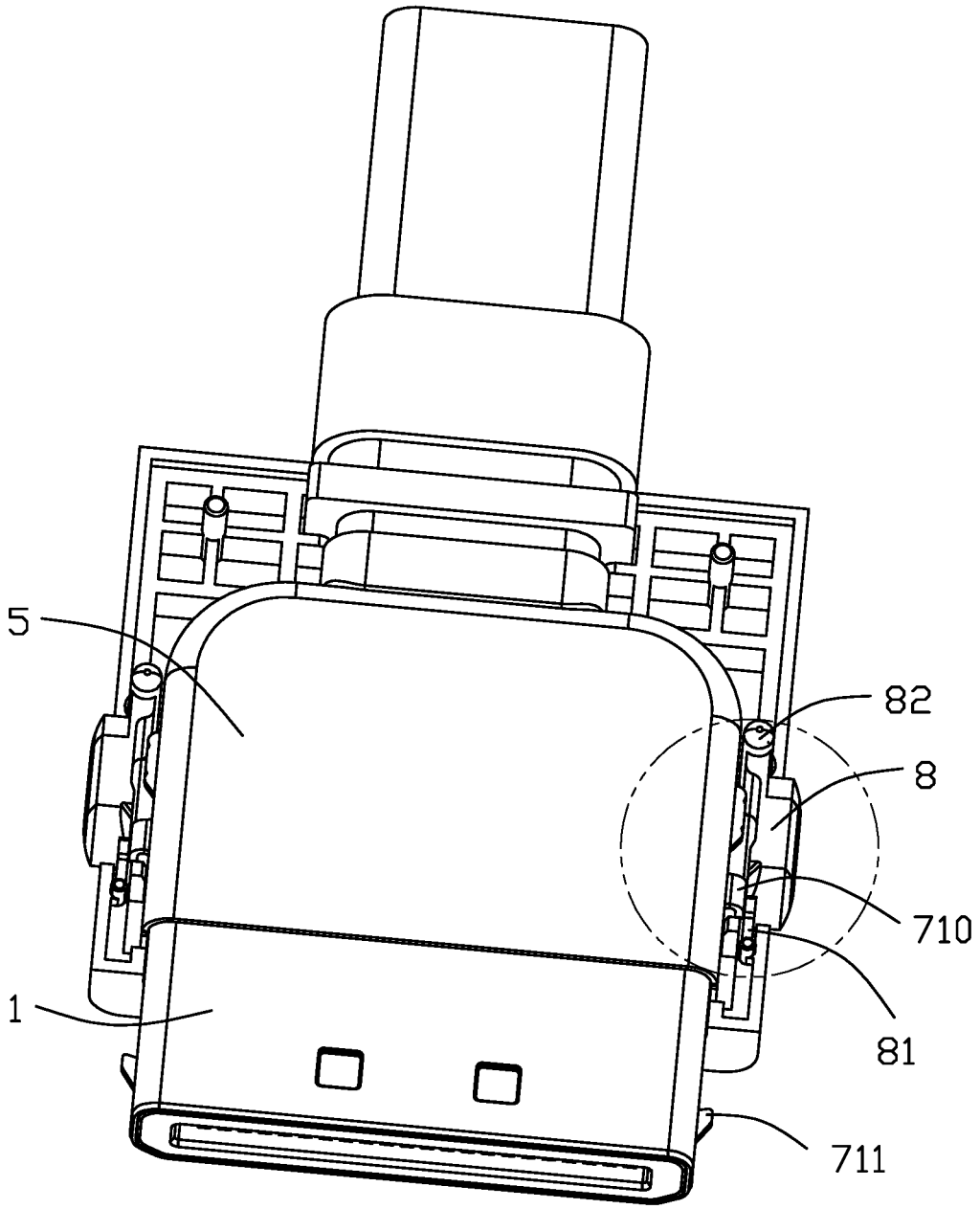
FIG. 2 is another perspective view of the electrical connector assembly, omitting part of an outer cover thereof.
Figure 3:
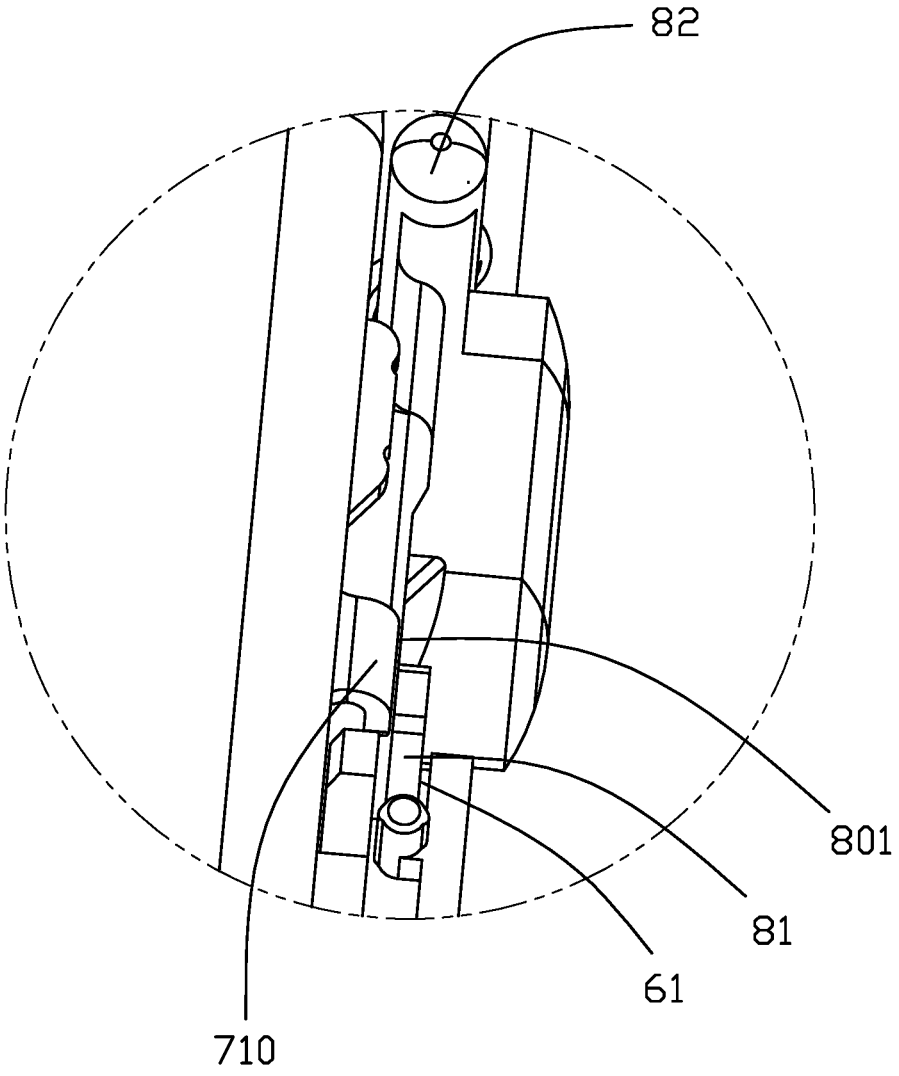
FIG. 3 is an enlarged view of a circled portion of the electrical connector assembly in FIG. 2.
Figure 4:
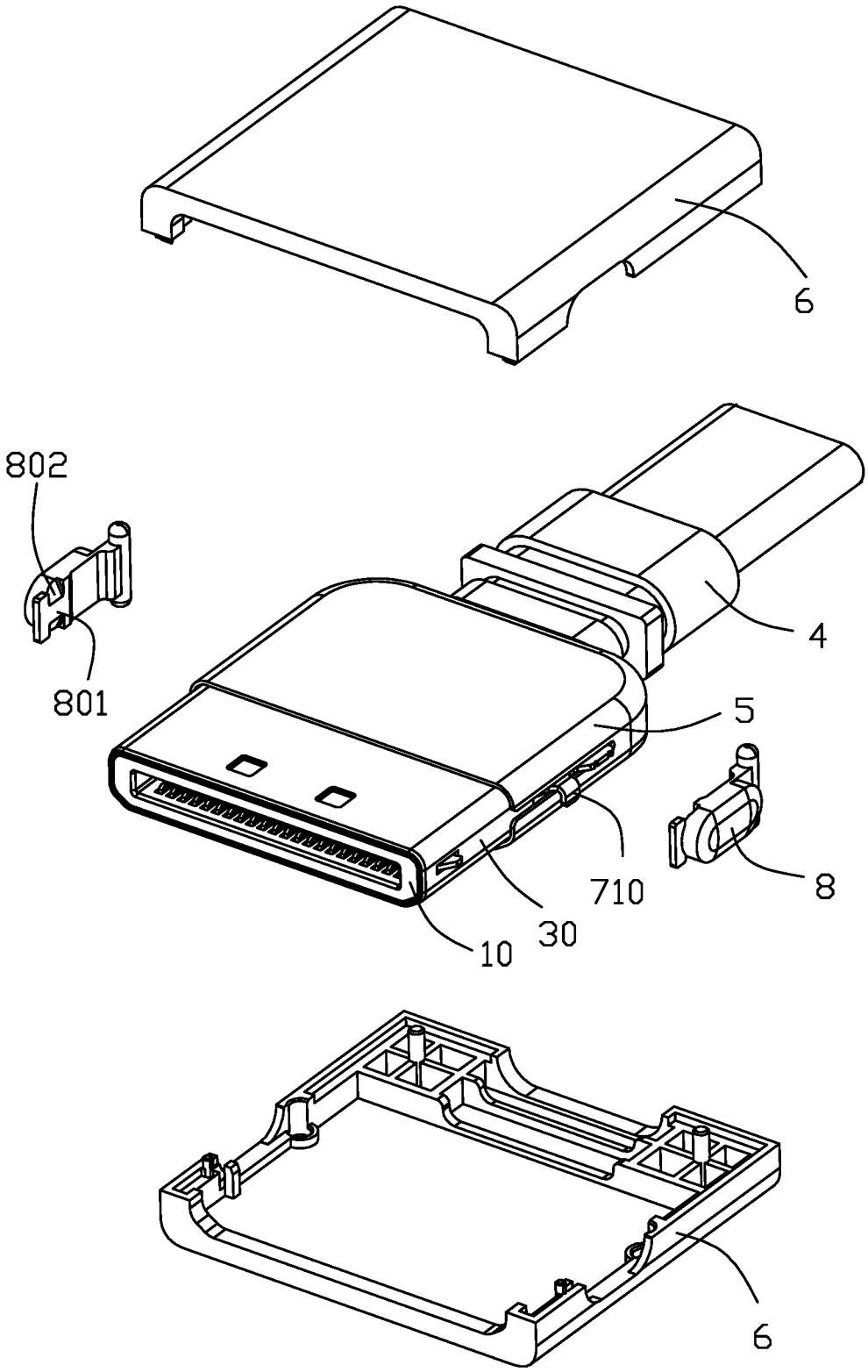
FIG. 4 is an exploded view of the electrical connector assembly.
Figure 5:
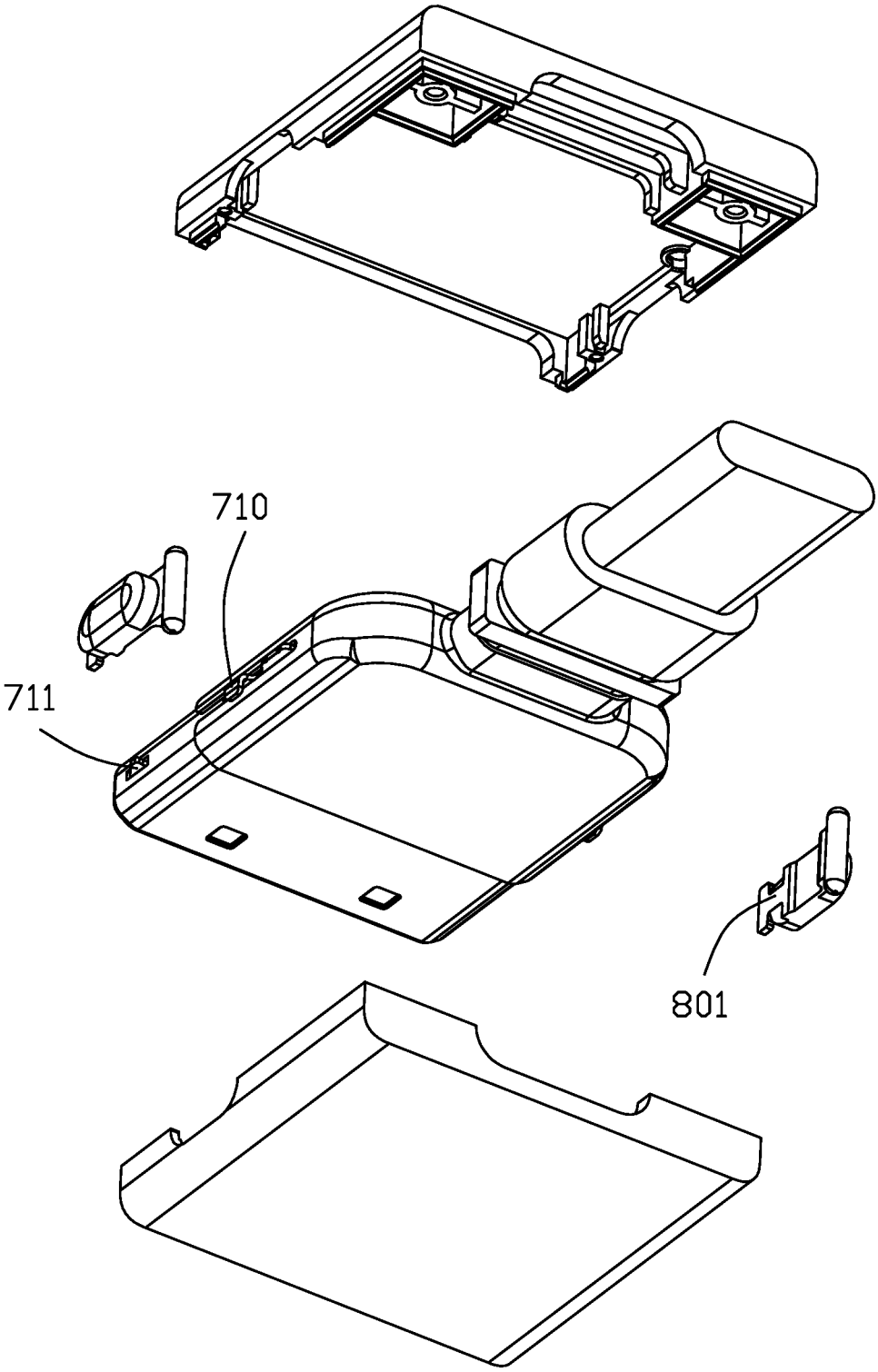
FIG. 5 is a view similar to FIG. 4 but from another perspective.

Referring to FIGS. 1-6, an electrical connector assembly 100 comprises a plug connector 1, a cable 4 electrically connecting to the plug connector 1, an outer cover 6 enclosing the plug connector 1 and the cable 4, a pair of latches 7 mounted to the plug connector 1, and a pair of buttons 8 mounted to the outer cover 6 for operating the pair of latches 7. The electrical connector 100 may further comprise a printed circuit board (PCB) 2 connected between the plug connector 1 and the cable 4, a wire organizer 3, and a metallic shell 5 enclosing a rear part of the plug connector 1.

Figure 6:
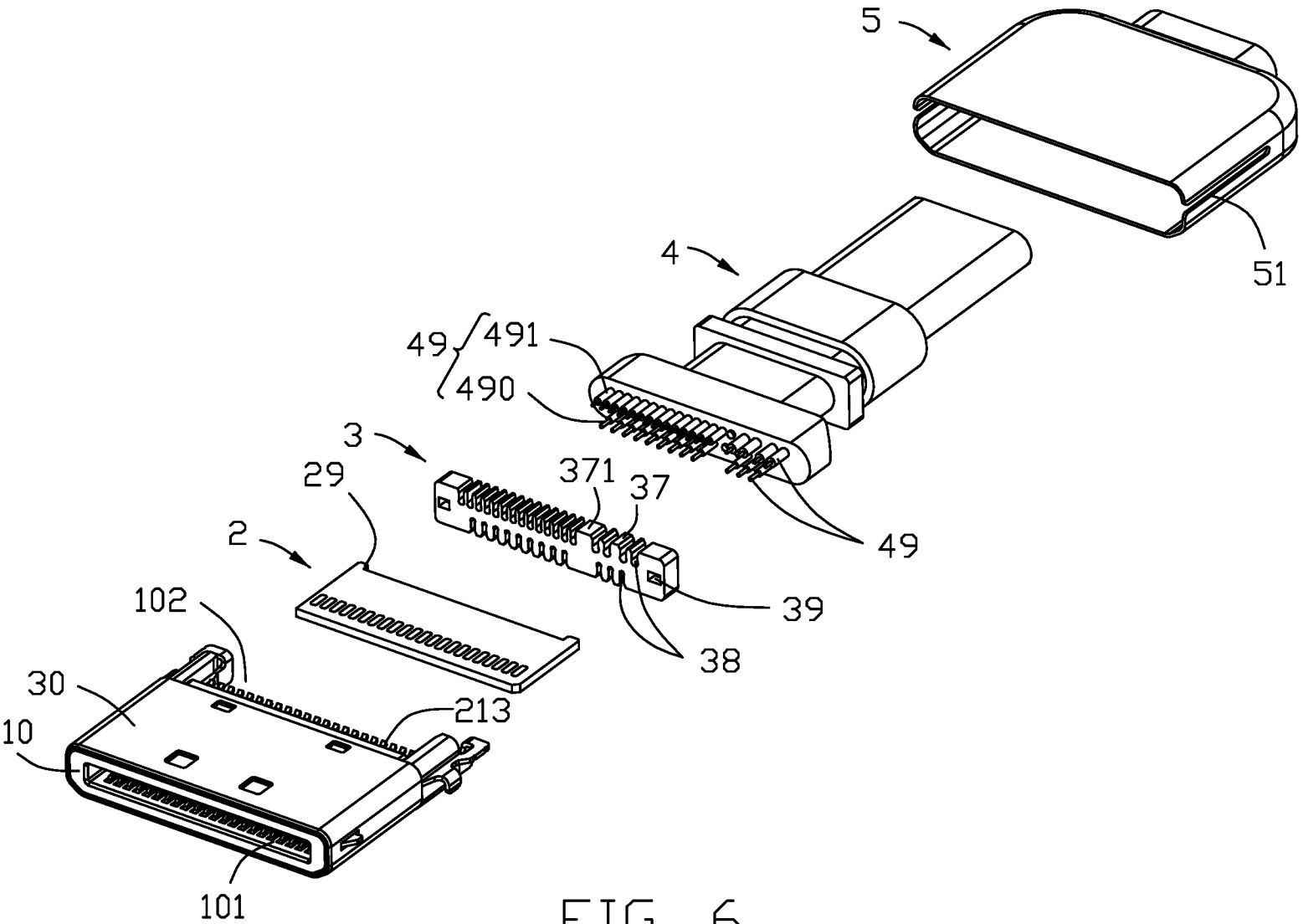
FIG. 6 is a further exploded view of the electrical connector assembly in FIG. 4.
Figure 7:
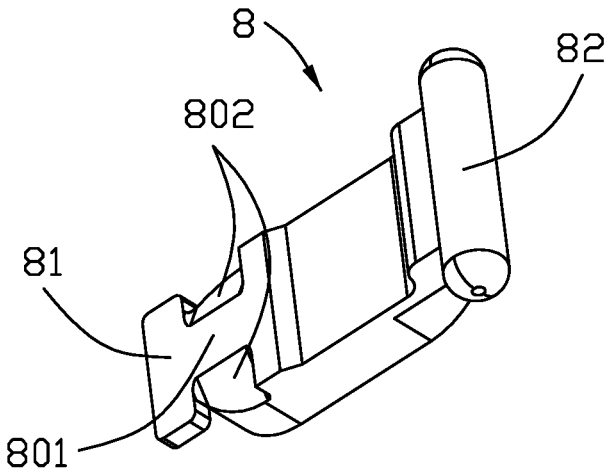
FIG. 7 is a perspective view of a button of the electrical connector assembly.
Figure 8:
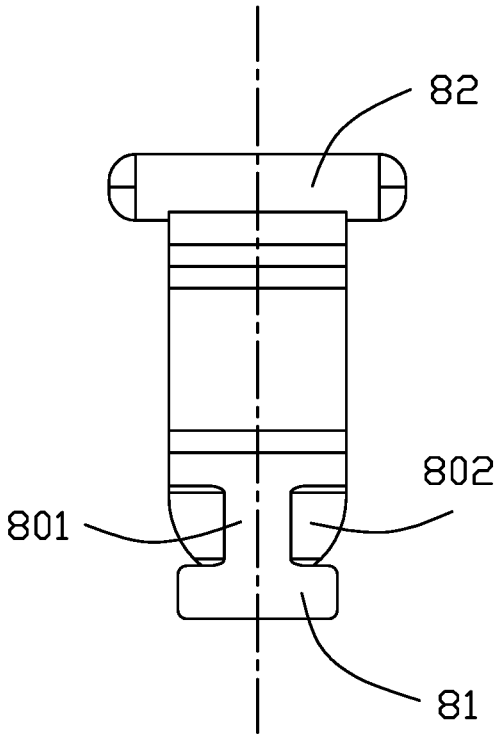
FIG. 8 is a plan view of the button.
Figure 9:
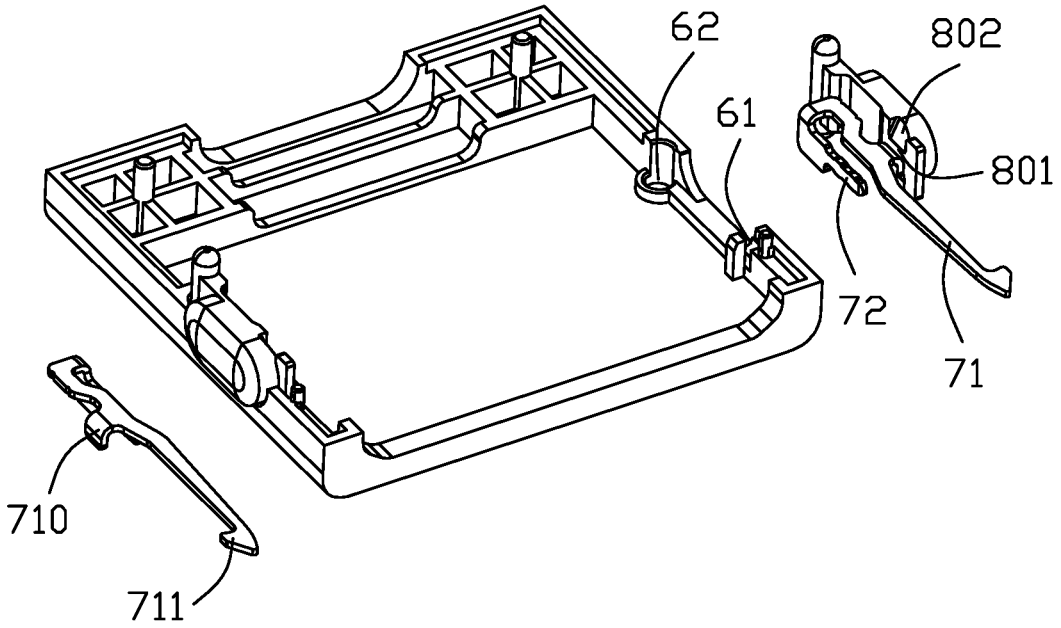
FIG. 9 is a perspective view showing a pair of latches, a pair of buttons, and part of the outer cover of the electrical connector assembly.
Figure 10:
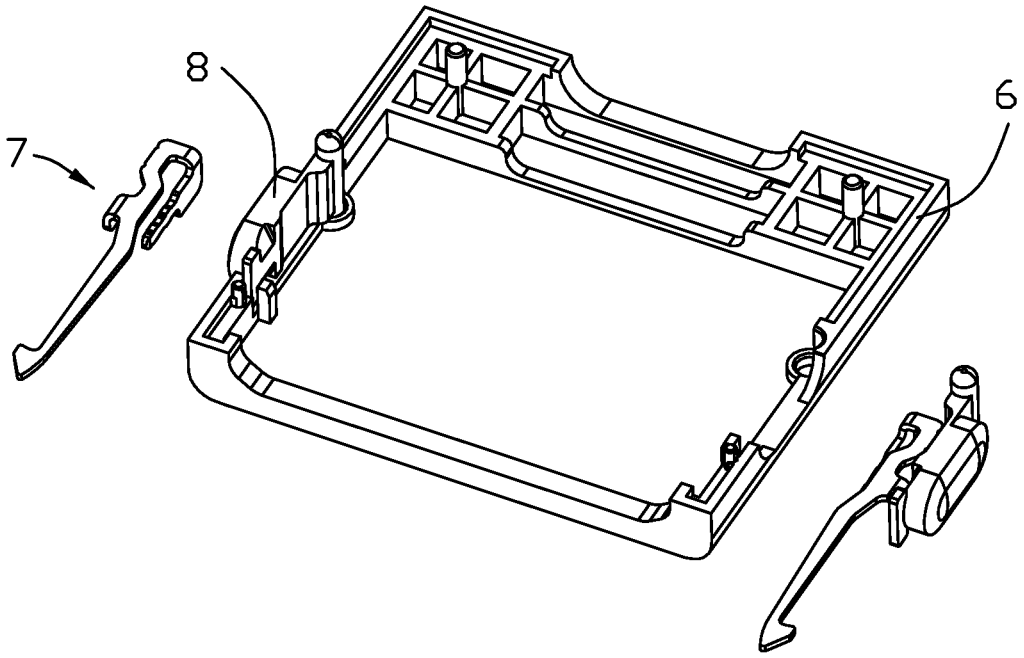
FIG. 10 is a view similar to FIG. 9 but from another perspective.
Figure 11:
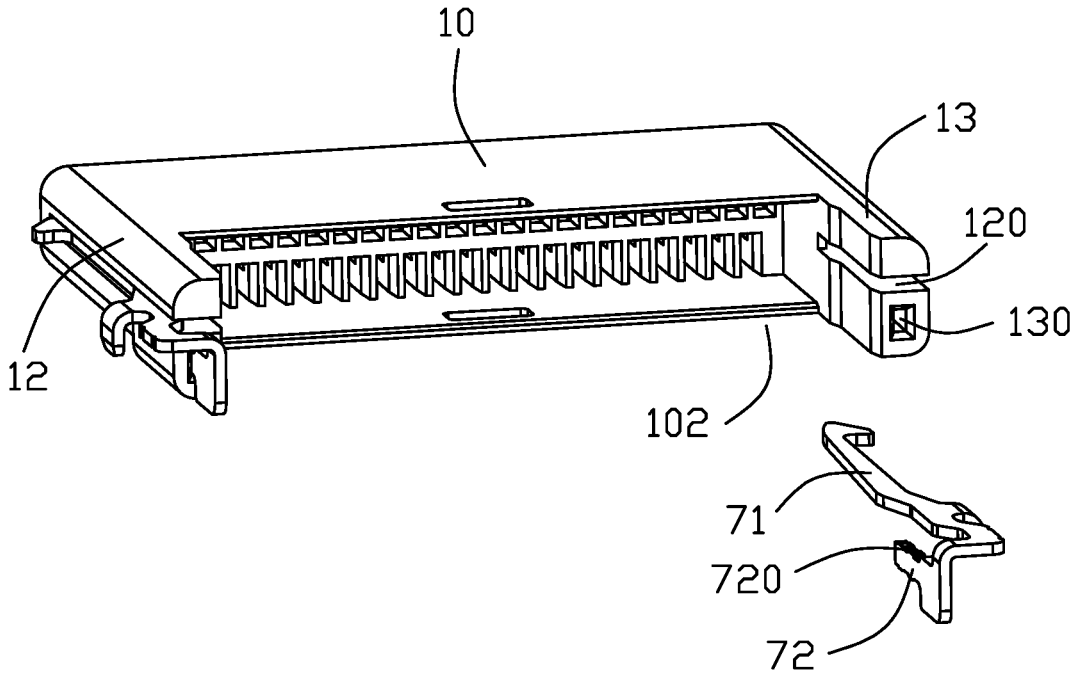
FIG. 11 is a perspective view showing the pair of latches and part of a plug connector of the electrical connector assembly.
Figure 12:
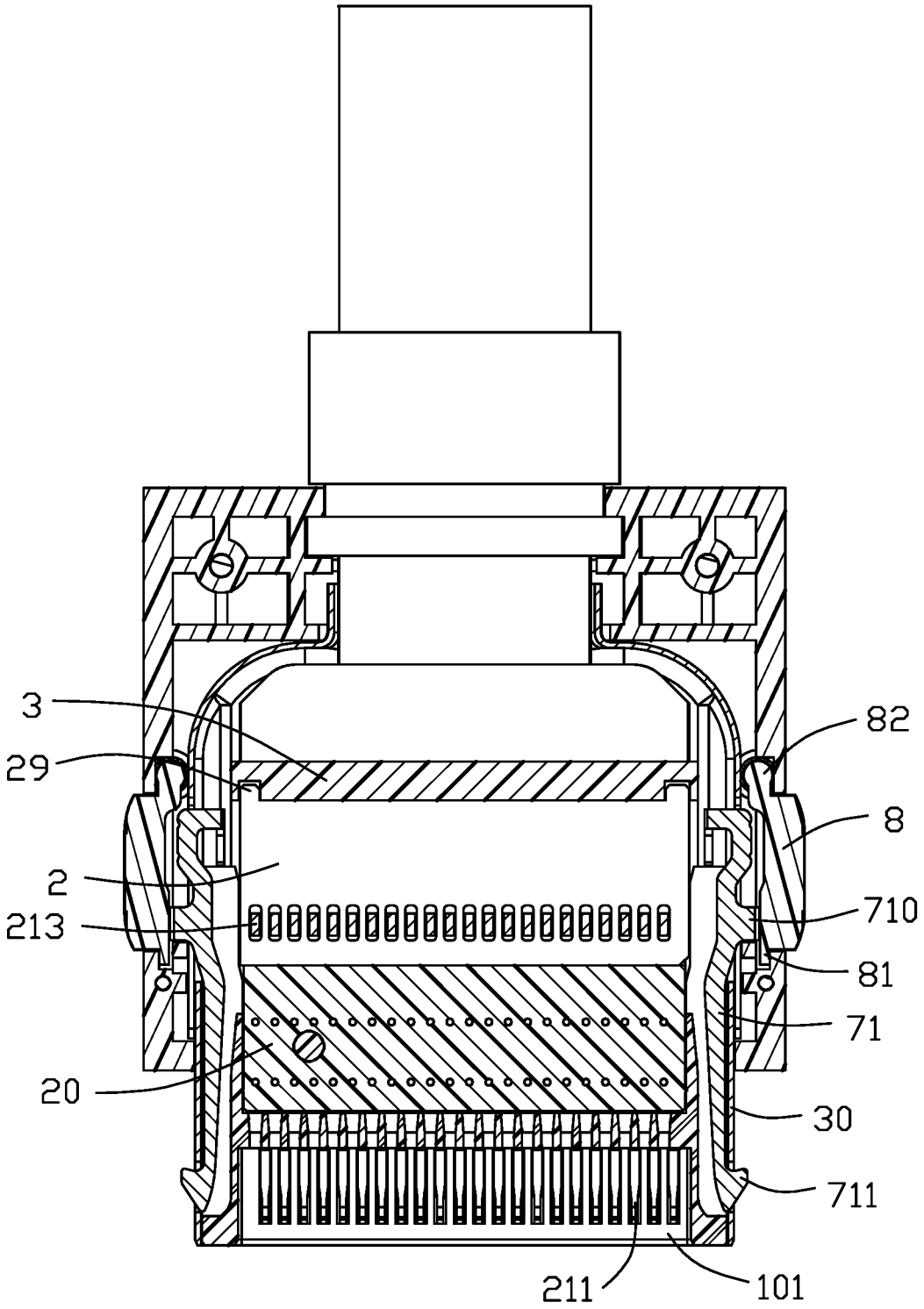
FIG. 12 is a cross-sectional view of the electrical connector assembly taken along line A-A in FIG. 1.
Figure 13:
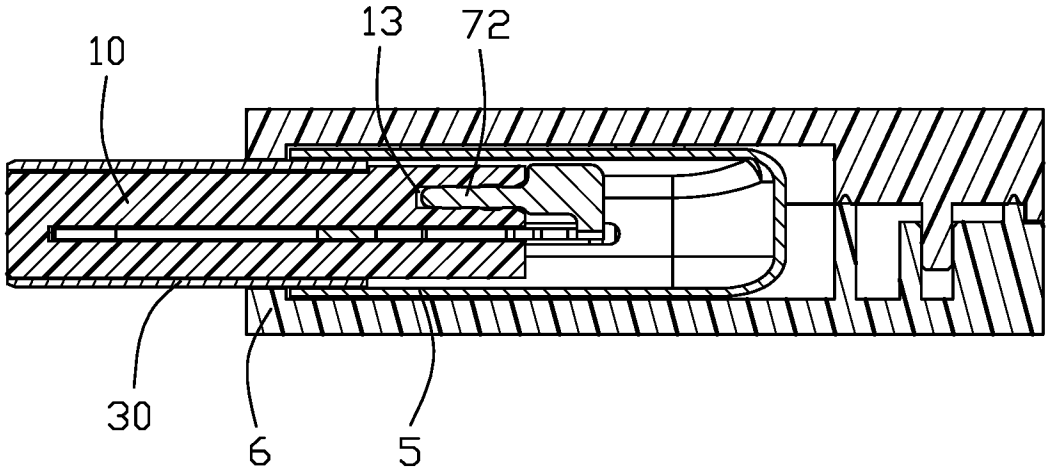
FIG. 13 is a cross-sectional view of the electrical connector assembly taken along line B-B in FIG. 1.
Figure 14:
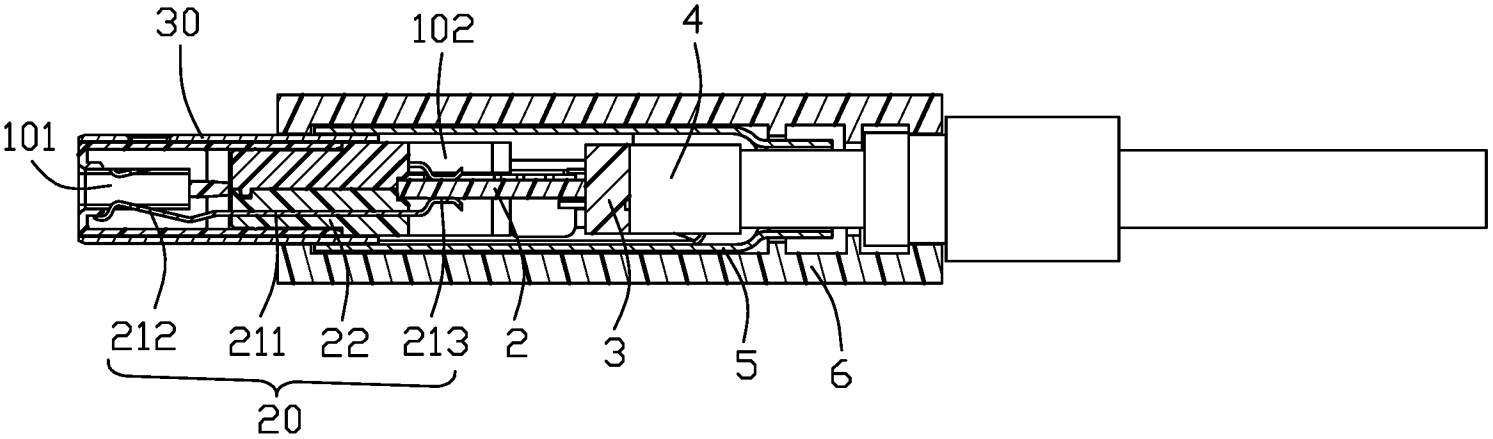
FIG. 14 is a cross-sectional view of the electrical connector assembly taken along line C-C in FIG. 1.

Referring to FIGS. 6 and 11-12, the plug connector 1 includes an insulative housing 10 and a contact module 20. The plug connector 1 may further include a metallic shell 30. The insulative housing 10 defines a receiving space 101 and has a pair of side walls 12. The pair of side walls 12 has respective extensions 13 defining a space 102. Each wall 12 has a slot 120 and a hole 130. The contact module 20 has two rows of contacts 21 and an upper and lower insulators 22. Each contact 21 has a securing portion 211, contacting portion 212, and a connecting leg 213.

The PCB 2 has a pair of protrusions 29 for engaging a pair of holes 39 of the wire organizer 3. The cable 4 includes plural wires 49 each having a center conductor 490 and an outer insulator 491. The wire organizer 3 has positioning grooves 38.

Referring to FIGS. 2-14, the latch 7 is mounted to the side wall 12. The latch 7 has a spring arm 71, a securing portion 72 at an inner side of the spring arm 71, and a pressing portion 710 at an outer side of the spring arm 71. The spring arm 71 is movable in the slot 120 while the pressing portion 710 is located outside the slot 120. The spring arm 71 is substantially horizontal, the securing portion 72 is bent from an inner side edge of the spring arm 71, and the pressing portion 710 is bent from an outer side edge of the spring arm 71. The spring arm 71 has a hook 711 extending through a hole of the metallic shell 30. The securing portion 72 is interference fit in the hole 130.

The button 8 is mounted to the outer cover 6 for operating the latch 7. The button 8 includes a pivot 82 at one end thereof, a stopper 81 at an opposite end thereof, and an abutting portion 801 coupled to the pressing portion 710 of the latch 7. The button 8 may further include a pair of sloped faces 802 on two opposite sides of the abutting portion 801. Specifically, the button 8 is designed to be symmetrical so that same design of button may be used for either left-hand side latch or right-hand side latch. Provision of the sloped face 802 facilitates mounting of the button 8 to the outer cover 6 after the latch 7 is mounted in place.

The metallic shell 5 has a slit 51. The pressing portion 710 of the latch 7 is located outside the shell 5 such that a further inward movement of the pressing portion 710 is limited by the shell 5. The outer cover 6 includes an upper half and a lower half together defining a pair of side openings 61. The button 8 is urged outward by the latch 7 while being confined in the opening 61 by the stopper 81. The upper half and the lower half of the cover 6 each have a respective slot 61 for accommodating the abutting portion 801 and a respective hole 62 for receiving the pivot 82.

What is claimed is:

1. An electrical connector assembly comprising:

a plug connector;

a cable electrically connecting to the plug connector;

an outer cover enclosing the plug connector and the cable;

a pair of latches mounted to the plug connector; and a pair of buttons mounted to the outer cover for operating the pair of latches; wherein each of the pair of latches includes a spring arm, a securing portion at an inner side of the spring arm, and a pressing portion at an outer side of the spring arm;

each of the pair of buttons includes a pivot at one end thereof, a stopper at an opposite end thereof, and an abutting portion coupled to the pressing portion; and the pivot of each button is received in a respective hole of the outer cover.

2. The electrical connector assembly as claimed in claim 1, wherein the spring arm is substantially horizontal, the securing portion is bent from an inner side edge of the spring arm, and the pressing portion is bent from an outer side edge of the spring arm.

3. The electrical connector assembly as claimed in claim 1, wherein the button comprises a pair of sloped faces on two opposite sides of the abutting portion for assisting in mounting the pair of buttons to the outer cover.

4. The electrical connector assembly as claimed in claim 1, wherein the outer cover includes an upper half and a lower half together defining a pair of side openings, and each of the pair of buttons is urged outward by a corresponding latch while is confined in a corresponding opening by the stopper thereof.

5. The electrical connector assembly as claimed in claim 1, wherein the securing portion of the latch is fixed to the plug connector.

6. The electrical connector assembly as claimed in claim 1, further comprising a metallic shell enclosing the plug connector, and wherein the pressing portion of the latch is located outside the metallic shell so that a further inward movement of the latch is limited by the metallic shell.

* * * * *